United States Patent [19]

Scheffel

[11] 4,300,454

[45] Nov. 17, 1981

[54] SELF-STEERING DAMPING RAILWAY TRUCK

[75] Inventor: Herbert Scheffel, Pretoria, South Africa

[73] Assignee: South African Inventions Development Corporation, Pretoria, South Africa

[21] Appl. No.: 959,382

[22] Filed: Nov. 9, 1978

Related U.S. Application Data

[63] Continuation-in-part of Ser. No. 757,278, Jan. 6, 1977, abandoned.

[30] Foreign Application Priority Data

Feb. 9, 1976 [ZA] South Africa ..... 76/0736

[51] Int. Cl.[3] ..... B61F 3/08; B61F 5/30; B61F 5/38; B61F 5/50

[52] U.S. Cl. ..... 105/168; 105/182 R; 105/210; 105/224.1; 267/9 A

[58] Field of Search ..... 105/164, 165, 166, 167, 105/168, 176, 182 R, 194, 199 R, 210, 224.1; 295/34; 267/9 A

[56] References Cited

U.S. PATENT DOCUMENTS

| | | | |
|---|---|---|---|
| 299,735 | 6/1884 | Candee | 105/194 X |
| 424,089 | 3/1890 | Bosdevex | 105/168 |
| 435,918 | 9/1890 | Clark | 105/168 |
| 562,406 | 6/1896 | Meek | 105/210 |
| 986,185 | 3/1911 | Lincoln | 105/165 |
| 1,051,214 | 1/1913 | Gawley | 105/168 |
| 1,142,379 | 6/1915 | Stevenson | 105/165 |
| 1,293,628 | 2/1919 | Coda | 295/34 |
| 1,640,179 | 8/1927 | Buckwalter | 105/182 R |
| 2,052,660 | 9/1936 | Rocard | 295/34 X |
| 2,071,502 | 2/1937 | Dalton | 105/194 |
| 2,352,039 | 6/1944 | Travilla, Jr. | 105/199 R |
| 3,528,374 | 9/1970 | Wickens | 105/165 X |
| 3,638,582 | 2/1972 | Beebe | 105/224.1 |
| 4,067,261 | 1/1979 | Scheffel | 105/176 X |
| 4,067,262 | 1/1979 | Scheffel | 295/34 X |
| 4,151,801 | 5/1979 | Scheffel et al. | 105/168 |

FOREIGN PATENT DOCUMENTS

| | | | |
|---|---|---|---|
| 722414 | 7/1942 | Fed. Rep. of Germany | 105/182 R |

*Primary Examiner*—Joseph F. Peters, Jr.
*Assistant Examiner*—Howard Beltran
*Attorney, Agent, or Firm*—Ladas & Parry

[57] ABSTRACT

A railway truck with a load-bearing structure resiliently supported on two live-axle, self-steering wheelsets, axle bearings being provided on the wheelsets and damping elements being connected longitudinally between axle bearings on the same side of the longitudinal axis of the truck. The damping elements change length with constantly applied forces and transmit rapidly changing forces between the wheelsets with the attenuation of energy. Thus, the damping elements do not interfere with the self-steering ability of the wheelsets and act to counteract wheelset hunting. The wheelsets may be connected to couple any yawing movement of each wheelset in opposite sense to the other wheelset.

8 Claims, 6 Drawing Figures

SELF-STEERING DAMPING RAILWAY TRUCK

This application is a continuation-in-part of co-pending application Ser. No. 757,278 filed Jan. 6, 1977, now abandoned, and is related to Pat. Nos. 4,067,261 and 4,067,262 granted Jan. 10, 1978, and No. 4,151,801 granted May 1, 1979.

This invention relates to railway vehicle suspensions. Particularly the invention is concerned with railway suspensions for railway vehicles fitted with "live" axle wheelsets which will simultaneously provide a good curving ability and hunting stability for the vehicle.

A vehicle fitted with "live" axle wheelsets, each comprising a pair of wheels fast on an axle, can be made to have a good curving ability if the wheelsets are self-steering, i.e. the wheelsets naturally align themselves radially relatively to the curve and perform a substantially purely rolling motion without the flanges of the wheels contacting the rail. However, such wheelsets tend to be dynamically unstable and the various vehicle masses such as wheelsets, bogie and body tend to oscillate or hunt. The forces inducing hunting increase with increasing speed of the vehicle.

The hunting stability of a vehicle is dependent on its suspension design and on the various suspension parameters, such as wheel tread conicity, yaw constraint on the wheelsets and damping between the various vehicle masses. Thus, once hunting stability of the vehicle is attained, it is necessary to ensure that the suspension parameters remain constant so that the hunting stability is retained in use. With conventional vehicles the tread conicity changes as a result of wear from a straight taper of normally less than 1/20 to a concave profile with an effective conicity of greater than 1/20 e.g. ¼ or even higher; such wear is unavoidable since the wheelsets are not self-steering and they also experience hunting both of which cause slip and hence wear. The hunting stability, if any, of conventional vehicles therefore changes with use.

It is an object of the invention to provide a railway truck having self-steering wheelsets with a suspension structure which serves to counteract hunting without interfering with the natural curving ability of the self-steering wheelsets.

In this specification the term "railway truck" is defined to mean a basic railway unit including a load-bearing structure supported on at least two wheelsets. Thus a railway truck may be a Four-Wheeler or else it may be a bogie on two of which a superstructure or body is pivotally supported.

In a railway truck having a longitudinal axis in its direction of travel and including a load-bearing structure, at least two self-steering live axie wheelsets, and axle bearings towards each end of each wheelset, the invention provides that axle bearings on the same side of the longitudinal axis of the truck are connected by damping elements that are pivotted to each bearing and that are constructed resistively to change length under forces acting between the axle bearings thereby changing length under constantly applied forces and transmitting rapidly changing forces between the bearings with the absorbtion of energy by the resistive change of length caused by those forces.

The damping elements according to theory and tests by the inventor, disturb the natural oscillations of the wheelsets during hunting and so cause hunting-stabilizing creep forces to be generated in the wheel/rail contact areas. The damping elements may also be regarded as elements or means which limit the degrees of freedom of the wheelsets to counteract hunting without affecting the natural self-steering ability of the wheelsets.

In practice the damping elements connecting the bearings include pneumatic, hydraulic, viscous or friction dampers, preferably viscous dampers, and one or more stiff beams or rods connecting the dampers to the bearings.

Conveniently suitable laterally extending flanges or brackets are fitted to the bearings to ensure that the damping elements are clear of any obstructions such as bolsters, brake components and the like.

In use the damping elements change length with negligable resistance in response to constantly applied forces, such as those experienced when the wheelsets yaw to assume radial positions in a curve, so that the natural self-steering ability of the wheelsets is unaffected. However, when rapidly oscillating forces, such as those arising when the wheelsets tend to hunt, are applied to the damping elements the resistance of these elements is appreciable. This is because any change in length occurs over a short period. Thus any movements of each of the wheelsets are effectively transmitted to the other wheelset, a portion of the movement of the first mentioned wheelset being absorbed by the change in length of the element. Since the damping force of the damping elements is velocity dependent and if there are no other connections between the wheelsets, it can be shown that the damping elements in this situation tend to cause the wheelsets to oscillate 90° out of phase; in practice, however, the phase difference is not always equal to 90°.

In a preferred form of the invention the wheelsets are coupled in pairs by means which cause each wheelset to yaw in opposite sense to the other wheelset, i.e. 180° out of phase with each other. The coupling means may take many forms, e.g. diagonally extending links which cross each other and are pivotally connected between the wheelsets; a pair of bissels pivotally connected to each other and to the wheelsets; and a pivoted lever having each of its ends pivotally connected by linkages to axle bearings on the same side of the longitudinal axis of the truck. With such constructions the coupling means significantly increases the hunting stability of the wheelsets and the damping elements serve further to stabilise hunting. This coupling between wheelsets would be useful where very high speeds are to be obtained or where the weight of the truck varies considerably between loaded and unloaded conditions.

The invention is further discussed with reference to the accompanying drawing, in which FIG. 1 shows a schematic plan view of one embodiment of the railway truck of the invention;

Figure 1:
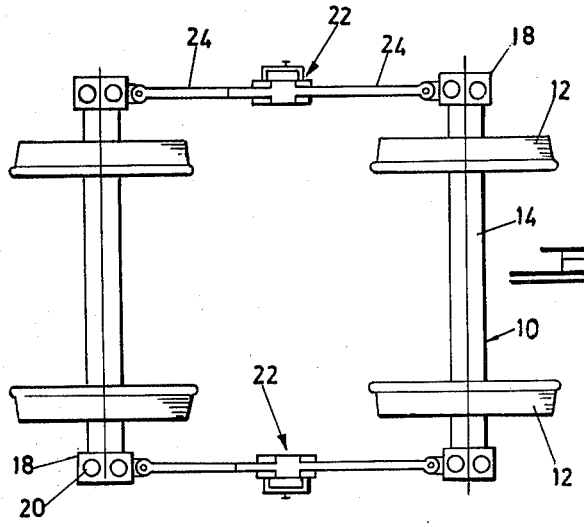
Figure 2:
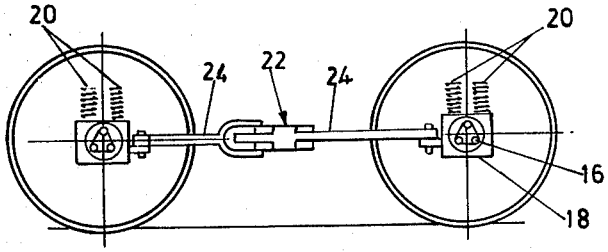
FIG. 2 shows a schematic side view of the truck of FIG. 1.

FIGS. 1 and 2 show a railway truck suspension including a pair of live axle wheelsets 10 each comprising a pair of wheels 12 with profiled treads fast on an axle 14. Towards each end of each wheelset 10 is shown schematically a bearing 16 supporting an adaptor 18. A pair of springs 20, which are shown as coil springs, but which may be any suitable resilient elements, are supported on each adaptor 18. The springs 20 will support a load-bearing structure (not shown), e.g. a bogie frame or a body depending on the type of truck. Adaptors 18 on the same side of the longitudinal axis of the truck are interconnected by a damping element comprising a damper 22 and connecting rods 24 that are solidly connected to the damper 22 and are pivotally connected to the adaptors 18. As shown in FIG. 2, one of the rods has a bifurcated end where it joins the damper 22.

A suitable form of hydraulic damper will be described below with reference to FIG. 3. Other components of the truck, such as the load-bearing structure, brakes, brake beams, etc. have not been shown or described as these may be of any known type and are not essential to this discussion.

The suspension is such that each wheelset 10 is substantially self-steering. The treads of the wheels 12 are profiled to a profile known as the "standard wear profile" and have a high effective conicity whereby steering forces may be generated on curved track by virtue of the difference in rolling diameters between the inner and outer wheels. The constraints against lateral and yawing movements of the wheelsets are made to be lower than the steering forces so that each wheelset may yaw to attain a radial position in a curve. The yaw constraint "K" may conveniently be determined from the following relationship:

$$K < 4G_r l^2, \text{ where } G_r \cong \tfrac{1}{2}\frac{W\gamma}{R\delta_0}$$

and where $G_r$ is known in the art as the "gravitational suspension stiffness";

W = the maximum axle-load selected for each wheelset;

R = the radius of curvature of the profile of the wheel-tread;

l = one half the distance between the wheel/rail contact points on the same wheelset;

$\delta$ = the angle between the wheel/rail contact plane and the horizontal with the wheelset in its central position;

$\epsilon$ = the effective conicity of the wheel-tread profile.

In practice the yaw constraint "K" is made to be lower than and about one quarter of the maximum value given above.

The profile used approximates that of a naturally worn wheel and has an effective conicity of about $\frac{1}{4}$ or 1/5.

Any wear of such self-steering wheelsets is minimal and the profile does not change significantly in use.

Figure 3:
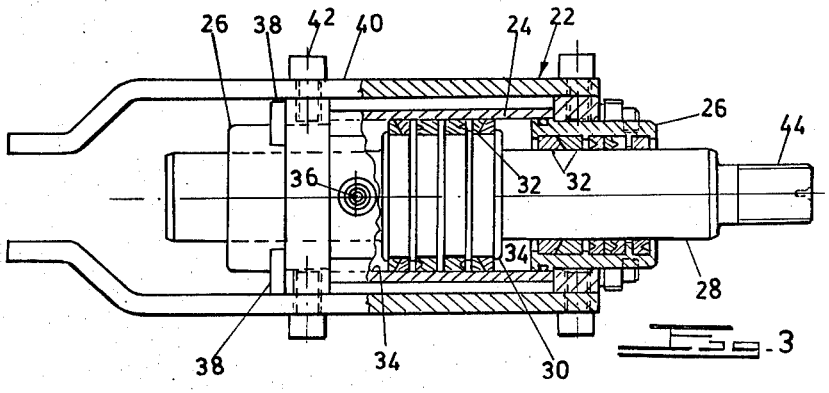
FIG. 3 shows a side view, partly broken away, of a viscous damper for a railway truck of the invention.

FIG. 3 shows a suitable double-acting hydraulic damper 22 for use with the invention. The damper 22 comprises a cylindrical casing 26 having end caps 28 and a piston 28 having an enlarged medial portion 30. Seals 32 of a suitable plastics material, such as nylon or polyurethane, seal the interfaces between the casing 24, end caps 26, and piston 28 to provide two variable volume closed spaces 34 one to each side of the enlarged portion 30 of the piston 28. A passage 36 extends through the wall of the casing into each of the closed spaces. A conduit (not shown) is connected between the passages to interconnect the spaces 34. A valve (not shown) is provided in the conduit so that the rate of flow therethrough and the damping force can be regulated. Preferably the valve is variable. Bolts 38 that extend through the end caps and casing hold them together. A plate 40 is secured, by further bolts 42, above and below the casing. The plates extend beyond one end of the damper and taper towards each other so that they can be welded to a rod 24. One end 44 of the piston 28 is provided with a threaded portion so that it can be connected to a rod 24.

Figure 4:
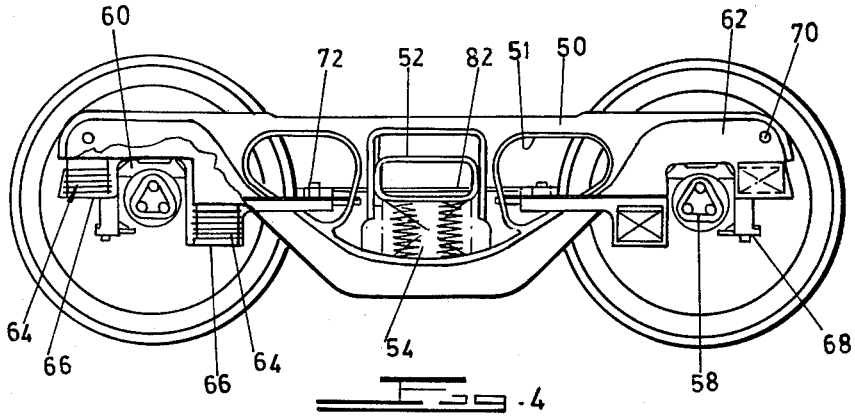
FIG. 4 shows a side view of another embodiment of the railway truck of the invention, parts being shown broken away for clarity.
Figure 5:
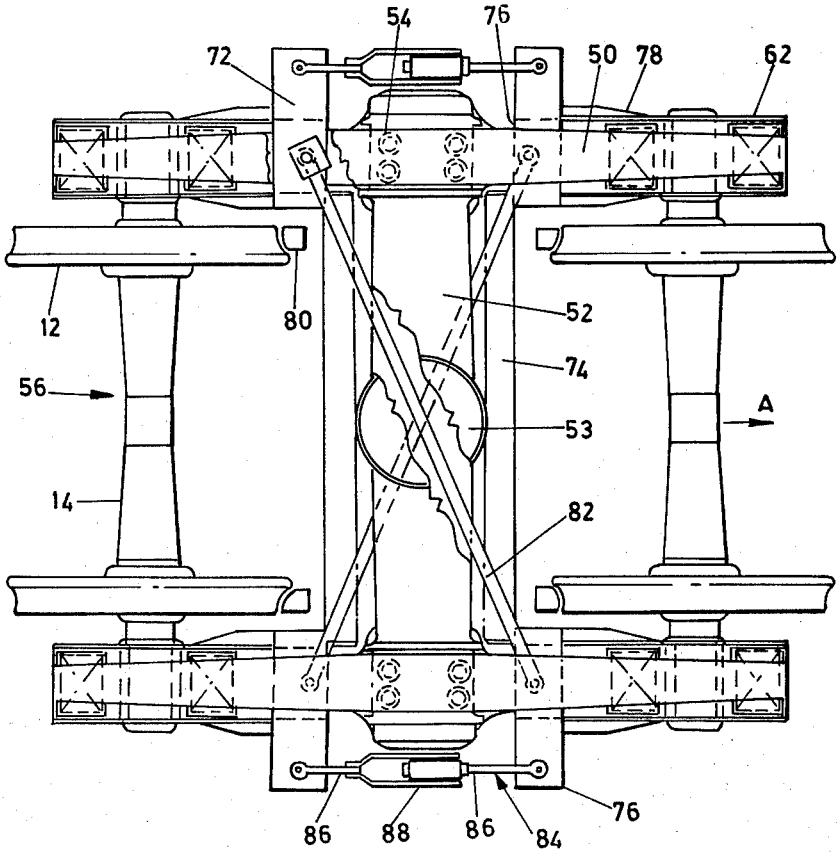
FIG. 5 shows a plan view of the railway truck of FIG. 4, again with parts being shown broken away for clarity.

FIGS. 4 and 5 of the drawings show a three-piece bogie including two side-frames 50 and a bolster 52 supported by coil springs 54 on the side-frames 50. The bolster is essentially of a hollow, elongate box construction. The side-frames 50 are suspended on two live axle sets 56 and have axle bearings 58 at each end. Each bearing 58 is connected to a side-frame 50 by means of a metal pad 60 having an arcuate lower surface which rests on the bearing 58; an adaptor 62 which rests on an upper surface of the pad 60; and two rubber sandwich elements 64 each of which is mounted on an upwardly facing spring seat 66 of the adaptor 62 and which support the side-frame 50. Each rubber sandwich element 64 comprises alternate layers of rubber and metal plate. The bolster has a conventional female wear-plate 53 for pivotally supporting a superstructure.

Each adaptor 62 is channel shaped in cross-section and comprises a web which rests on the pad and two spaced apart horizontal supports providing the spring seats 66 connected to opposed sides of the web. The supports straddle the bearing. A depending bracket 68 is secured to a support to provide a mounting for a key which prevents the adaptor 62 from being separated from the bearing in the event of excessive relative vertical movement. A pin 70 passing through registering holes in the adaptor 62 and a relatively larger hole in the side-frame 50 is provided to hold the adaptor to the side-frame in the event of gross relative vertical movement. The pad 24 may be welded to the adaptor, alternatively the pad 24 may be a snug fit between the walls of the adaptor 26 which straddle the pad 24.

A U-shaped extension member 72 is secured to each adaptor 62 and a beam 74 is connected between the free ends of the extension members on each wheelset to form a moment transmitting sub-frame on that wheelset. Each extension member 72 comprises a plate 76, which passed through a hole 51 formed in the side-frame, and struts 78 which secure the plate 76 to the sides of the adaptor. The beam 74 is connected between the plates 76 of the extension members 72.

Single-acting brakes 80 are provided for each wheel. Brakebeams and other components for the brakes have not been shown as these may be of any known form.

The wheelsets 56 are made to be self-steering as discussed above.

The wheelsets are interconnected to couple their yawing movements in opposite senses by links 82 that extend diagonally across the truck, cross-each other, and are pivotally connected to the plates 76. The links 82 pass freely through clearance spaces formed in the bolster 52.

FIG. 5 shows damping elements 84 connected longitudinally between the adaptors, that is the bearings, of a pair of wheelsets. For clarity only these elements 84 are not shown in FIG. 4. The damping element 84 comprises a rod 86 pivotally connected to a laterally projecting portion of each plate 76 and a damper 88 of the type shown in FIG. 3.

The operation of the suspension of the invention may be explained as follows.

FIGS. 1 and 2 show the essential features only of the railway truck of the invention which includes self-steering wheelsets that are resiliently suspended to a load-bearing structure and parallel damping elements connecting axle bearings on the same side of the truck longitudinally to each other. By being self-steering each wheelset has a tendency to hunt. This tendency is to a certain extent counteracted by each wheelset being laterally and longitudinally suspended to the load-bearing structure. It has been found that the lateral and longitudinal suspension of the wheelsets to the load-bearing structure limits the degrees of freedom of each wheelset and causes interactions between the lateral and yaw movements of the wheelsets and of load-bearing structure which are stabilising. The parallel damping elements further limit the degrees of freedom of each wheelset and so increases hunting stability. As will be appreciated by skilled persons, viscous dampers provide a damping force that is velocity dependent, i.e. depends on the relative movements of the wheelsets, and as a result each wheelset is urged to move 90° of of phase with the other wheelset and out of phase with the load-bearing structure. This disturbes the natural oscillations of the wheelsets and induces stabilising creep forces in the wheel/rail contact regions. By similar reasoning it will be seen that hunting of the load-bearing structure is also counteracted.

With the embodiment of FIGS. 4 and 5 the diagonal links coupling the wheelsets cause them to yaw in opposite senses. i.e. 180° out of phase. This limits the degrees of freedom allowed each wheelset and in combination with the resilient suspension element acts to counteract any tendency to hunting of the wheelsets; the effect of the diagonal links or any other so called "diagonal" or "radial suspension" increases the hunting stability of the self-steering wheelsets significantly so that such a truck may be run at 300 to 400 k.p.h. The parallel damping elements further increase the hunting stability and reduce the sensitivity of the wheelsets to track irregularities. The reason for this is that the diagonal suspension makes the wheelsets stable with respect to hunting, i.e. oscillations tend to decay with time. However, the distance travelled before any oscillations decrease increases with increasing speed. The damping elements ensure a more rapid decay of such oscillations.

As will be appreciated by persons skilled in the art, the diagonal links may be replaced by any other coupling means between the wheelsets which acts to couple the yawing movements of the wheelsets in opposite sense. Examples of such coupling means are disclosed in U.S. Pat. Nos. 4,067,261, Scheffel and 4,067,262 Scheffel and 4,151,801 Scheffel et al and co-pending application Ser. No. 702,365 Scheffel, now abandoned.

Figure 6:
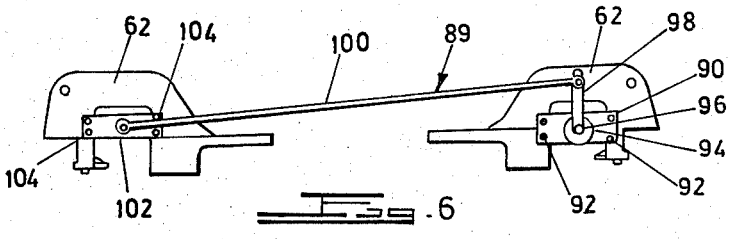
FIG. 6 shows a side view of a variant of damping element for the invention.

FIG. 6 shows a variant of damping element connected between adaptors 62 of adjacent wheelsets, the adaptors being shown in outline. The damping element includes a plate 90 secured by bolts 92 to an adaptor of one wheelset. A rotary damper 94 of a suitable commercially available type is secured to the plate 90. An axially extending actuating shaft 96 of the damper 94 carries an arm 98. A connecting rod 100 is connected by ball joints or pin joints between the free end of the arm 98 and a plate 102 secured by bolts 104 to the adaptor of the other wheelset. Relative longitudinal movement of the interconnected ends of the wheelsets causes the arm 98 to pivot and actuate the damper 94.

With all the above-described embodiments the damping elements do not substantially interfere with the self-steering ability of the wheelsets. In practice, when the truck enters a curve each wheelset yaws to attain a radial position on the curve as a result of the steering forces arising from the differential effect of the profiled wheel treads. This yawing movement is resistively opposed by the dampers as their lengths vary until the ideal radial position is attained after which the dampers in no way influence the positioning of the wheelsets. The transient resistive effect the dampers have on the self-steering ability of the wheelsets when the vehicle enters the curve is negligible since yawing of the wheelsets from a straight ahead position to a radial position takes place over a relatively long period.

As described above the railway truck of the invention has self-steering wheelsets and is stable with respect to wheelset hunting. As such the suspension parameters do not vary significantly in use and the hunting stability of the truck is retained in service.

I claim:

1. A railway truck having a longitudinal axis in its direction of travel and including:

(a) a load bearing structure;

(b) two wheelsets each comprising a pair of wheels fast on an axle, the wheels having treads that are profiled and have a high effective conicity to generate steering forces on curved track by the conicity of the tread independently of the wheel flange;

(c) axle bearing means on each wheelset;

(d) axle box adaptor means secured to each axle bearing means;

(e) resilient means suspending the load-bearing structure to the wheelsets through the axle box adaptor means and the axle bearing means to provide elastic constraints to yawing and lateral movements of each wheelset relatively to the load-bearing structure, the elastic constraints on each wheelset being lower than the steering forces generated by the high conicity tread on curved track whereby each wheelset is self-steering;

(f) damping means on each side of the logitudinal axis of the truck, each damping means being pivotally connected between the axle box adaptor means of the wheelsets and acting longitudinally resistively to oppose changes in spacing between ends of the wheelsets on the same side of the longitudinal axis of the truck; and (g) means interconnecting the wheelsets to couple any yawing moment of each wheelset in opposite sense to the other wheelset on straight and curved track, said interconnecting means comprises two linkages which cross each other and which are connected to diagonally opposed axle bearing adapter means;

(h) the interconnecting means and the damping means acting to generate hunting stabilizing creep forces.

2. A railway truck as claimed in claim 1, wherein the interconnecting means comprises a sub-frame on each wheelset, each sub-frame being connected to the axle bearing adaptor means of the wheelset to transmit moments to the wheelset in a horizontal plane, and the diagonally extending linkages being pivotally connected between the sub-frames.

3. A railway truck as claimed in claim 1, in which each damping element includes a hydraulic damper and at least one stiff beam connecting the damper between the axle bearings.

4. A railway truck as claimed in claim 1, in which each damping elements includes a hydraulic damper and a pair of stiff beams connecting the damper to the axle bearings, each beam being solidly connected to a part of the damper and being pivotally connected to the axle bearing.

5. A railway truck as claimed in claim 1, in which the damping element includes a viscous hydraulic damper that provides a velocity dependent damping force.

6. A railway truck as claimed in claim 1, in which the damping element includes a telescopic hydraulic damper.

7. A railway truck as claimed in claim 1, in which the damping element includes a rotary hydraulic damper that is mounted on the axle bearing of one wheelset and has a radially extending arm and a linkage pivotally connected between the radially extending arm and the axle bearing of the other wheelset.

8. A railway truck as claimed in claim 1, in which the damping element includes a hydraulic damper the damping force of which is variable.

* * * * *